US008820738B2

(12) United States Patent
Deno

(10) Patent No.: US 8,820,738 B2
(45) Date of Patent: Sep. 2, 2014

(54) SHEET CONVEYANCE APPARATUS AND IMAGE FORMING APPARATUS

(71) Applicant: Canon Kabushiki Kaisha, Tokyo (JP)

(72) Inventor: Kouhei Deno, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/867,852

(22) Filed: Apr. 22, 2013

(65) Prior Publication Data

US 2013/0285315 A1 Oct. 31, 2013

(30) Foreign Application Priority Data

Apr. 27, 2012 (JP) ..... 2012-102480

(51) Int. Cl.
*B65H 9/04* (2006.01)
*B65H 9/00* (2006.01)
*B65H 5/06* (2006.01)

(52) U.S. Cl.
CPC ..... *B65H 9/006* (2013.01); *B65H 5/062* (2013.01)
USPC ..... 271/242; 271/272; 271/228; 271/252

(58) Field of Classification Search
CPC ..... B65H 9/006; B65H 5/062
USPC ..... 271/226–228, 242, 248–253, 272, 239
See application file for complete search history.

(56) References Cited

U.S. PATENT DOCUMENTS

| | | | | |
|---|---|---|---|---|
| 4,685,664 | A * | 8/1987 | Petersdorf | 271/227 |
| 4,823,159 | A * | 4/1989 | Yamamoto et al. | 399/394 |
| 5,335,904 | A * | 8/1994 | Ryuzaki | 271/272 |
| 5,362,041 | A * | 11/1994 | Ryuzaki et al. | 271/236 |
| 7,857,308 | B2 * | 12/2010 | Nakazawa et al. | 271/252 |
| 2009/0295079 | A1 * | 12/2009 | Kinoshita et al. | 271/242 |

FOREIGN PATENT DOCUMENTS

| | | | |
|---|---|---|---|
| JP | 59-4552 | A | 11/1984 |
| JP | 3191834 | B2 | 7/2001 |
| JP | 2009-286547 | A | 12/2009 |

* cited by examiner

*Primary Examiner* — Luis A Gonzalez
(74) *Attorney, Agent, or Firm* — Canon USA, Inc., IP Division

(57) ABSTRACT

A sheet conveyance apparatus includes a conveyance roller pair and a mechanism. While following movement of the sheet nipped by the conveyance roller pair, the mechanism moves the conveyance roller pair from a home position, and, in response to a trailing edge of the sheet passing through a conveyance roller pair nip portion, the mechanism returns the pair to the home position. The mechanism includes a movement supporting portion, a cam, a pressing member, and an urging member. The pressing member urges the conveyance roller pair toward the home position by exerting an urging force to the cam. In response to the conveyance roller pair and one of the cam and the pressing member moving in the width direction from the home position, the pressing member exerts the urging force to the cam in a direction reverse to a direction in which the conveyance roller pair has moved.

20 Claims, 12 Drawing Sheets

SHEET CONVEYANCE APPARATUS AND IMAGE FORMING APPARATUS

BACKGROUND OF THE INVENTION

1. Field of the Invention

The present invention relates to a sheet conveyance apparatus configured to convey a sheet and to an image forming apparatus equipped with the sheet conveyance apparatus.

2. Description of the Related Art

Conventionally, an image forming apparatus is provided with a skew correction mechanism for correcting a skew of a sheet being conveyed, in order to align a sheet with a position of an image formed on the sheet, and a width-direction correction mechanism for correcting a position in a direction which perpendicularly crosses a conveyance direction of sheet (hereinafter, referred to as a width direction of sheet).

The skew correction mechanism is a mechanism, when the sheet being conveyed becomes skewed, for correcting the sheet orientation. The width-direction correction mechanism is a mechanism for correcting a deviation from a conveyance reference position in the width direction of the sheet which occurs in the middle of conveyance of the sheet or at the time of the skew correction by the skew correction mechanism.

Japanese Patent Application Laid-Open No. 59-4552 discusses a configuration, as a skew correction mechanism, for causing a leading edge of a sheet conveyed by a roller pair (hereinafter, referred to as a conveyance roller pair) provided upstream of a registration roller pair to contact the registration roller pair to allow the sheet to form a loop thereon, thereby correcting a skew of the leading edge portion of the sheet. Further, Japanese Patent Application Laid-Open No. 59-4552 discusses a configuration, as the width-direction correction mechanism, for correcting a position in the width direction of the sheet by moving the registration roller pair in the width direction of the sheet, while nipping the sheet by the conveyance roller pair and the registration roller pair.

However, as described above, when the image forming apparatus corrects the skew by forming the loop on the sheet, or, when the image forming apparatus moves the registration roller pair in the width direction, the sheet being nipped by the conveyance roller pair is twisted to cause the skew or wrinkles on the sheet in some cases.

Thus, Japanese Patent No. 3191834 discusses a sheet conveyance apparatus configured to allow the conveyance roller pair to be movable in the width direction of the sheet while nipping the sheet, in order to prevent a twist of the sheet. In the sheet conveyance apparatus, by arranging compression springs at both end portions in the width direction of the conveyance roller pair, the conveyance roller pair is movable in the width direction from a home position while following the sheet, without using a driving source. Then, the conveyance roller pair, which has moved in the width direction while following the preceding sheet, needs to return to a position before the movement (the home position), before a trailing edge of the preceding sheet passes through a rear end of the conveyance roller pair and a leading edge of the subsequent sheet reaches the conveyance roller pair. In the configuration discussed in Japanese Patent No. 3191834, the conveyance roller pair, which has moved while following the sheet, is returned from the moved position to the home position, by an elastic force of compression springs provided at both end portions in the width direction of the conveyance roller pair.

In the configuration discussed in the above-described Japanese Patent No. 3191834, when the conveyance roller pair is situated at the home position, elastic forces from both directions of the compression springs provided at both end portions in the width direction are balanced. However, in a case where the conveyance roller pair is situated at a deviated position from the home position, a difference between the elastic forces of the compression springs provided both end portions is equivalent to a force for returning the conveyance roller pair from the deviated position to the home position. As a result, the returning force becomes smaller. This is because a force for returning the conveyance roller pair to the home position by the compression spring at one side is weakened by a force in a reverse direction by the compression spring at the other side. As a result, when the conveyance roller pair, which has moved while following the sheet, returns from the moved position to the home position after the trailing edge of the sheet has passed through the conveyance roller pair, the conveyance roller pair may stop, in some cases, at a position deviated from the home position. In particular, since a force applied by the compression springs becomes weak in the vicinity of the home position, and a force for returning the conveyance roller pair to the home position becomes weak, the conveyance roller pair tends to stop in the middle of returning to the home position.

In this way, if the conveyance roller pair stops at the deviated position without returning to the home position, the sheet cannot be conveyed properly, that is, the sheet is skewed, and a position in the width direction of the sheet is deviated.

In this case, the conveyance roller pair may be configured to increase a force for returning from a position, at which the conveyance roller pair is deviated, to the home position, by strengthening an elastic force of the compression springs by increasing a spring constant of the compression springs, for example, provided at both end portions in the width direction of the conveyance roller pair. However, when the elastic force of the compression springs provided at both end portions in the width direction of the conveyance roller pair is strengthened, a force for causing the conveyance roller pair to move while following the sheet becomes large. As a result, that causes a twist, or a skew, or wrinkles of the sheet.

SUMMARY OF THE INVENTION

The present invention is directed to a sheet conveyance apparatus capable of returning a conveyance roller pair, which has moved from a home position while following a sheet which moves in a width direction, to the home position with reliability.

According to an aspect of the present invention, a sheet conveyance apparatus includes a conveyance roller pair configured to convey a sheet while nipping the sheet, and a conveyance roller pair movement mechanism configured to, while following movement of the sheet nipped by the conveyance roller pair in a width direction which perpendicularly crosses a sheet conveyance direction, move the conveyance roller pair from a home position, and, in response to a trailing edge of the sheet passing through a nip portion of the conveyance roller pair, to return the conveyance roller pair to the home position, wherein the conveyance roller pair movement mechanism includes: a movement supporting portion configured to support the conveyance roller pair movable in the width direction, a cam connected to one of an apparatus main body and the conveyance roller pair, a pressing member connected to other of the apparatus main body and the conveyance roller pair and configured to come into contact with a cam surface of the cam, and an urging member configured to urge one of the cam and the pressing member against the other, wherein the pressing member urges the conveyance roller pair toward the home position by exerting an urging force from the urging member in the width direction to the cam, and wherein, in response to the conveyance roller pair and one of the cam and the pressing member connected to the conveyance roller pair moving in the width direction from the home position, the pressing member exerts the urging force to the cam in a direction reverse to a direction in which the conveyance roller pair has moved in the width direction, in response to the urging force from the urging member being exerted to the cam surface.

According to the exemplary embodiments of the present invention, a conveyance roller pair, which has moved from a home position while following a sheet moving in a width direction, can be returned to the home position with reliability.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings. In an example, a sheet conveyance apparatus is capable of returning a conveyance roller pair, which has moved from a home position while following a sheet which moves in a width direction, to the home position with reliability. The sheet conveyance apparatus includes a conveyance roller pair movement mechanism configured to move the conveyance roller pair from the home position while following movement of the sheet in the width direction which perpendicularly crosses a sheet conveyance direction. The sheet conveyance apparatus further includes a slide cam provided with an inclined surface, a pressing roller configured to come into contact with the slide cam, and an elastic member configured to urge one of the slide cam and the pressing roller against the other.

Figure 10:
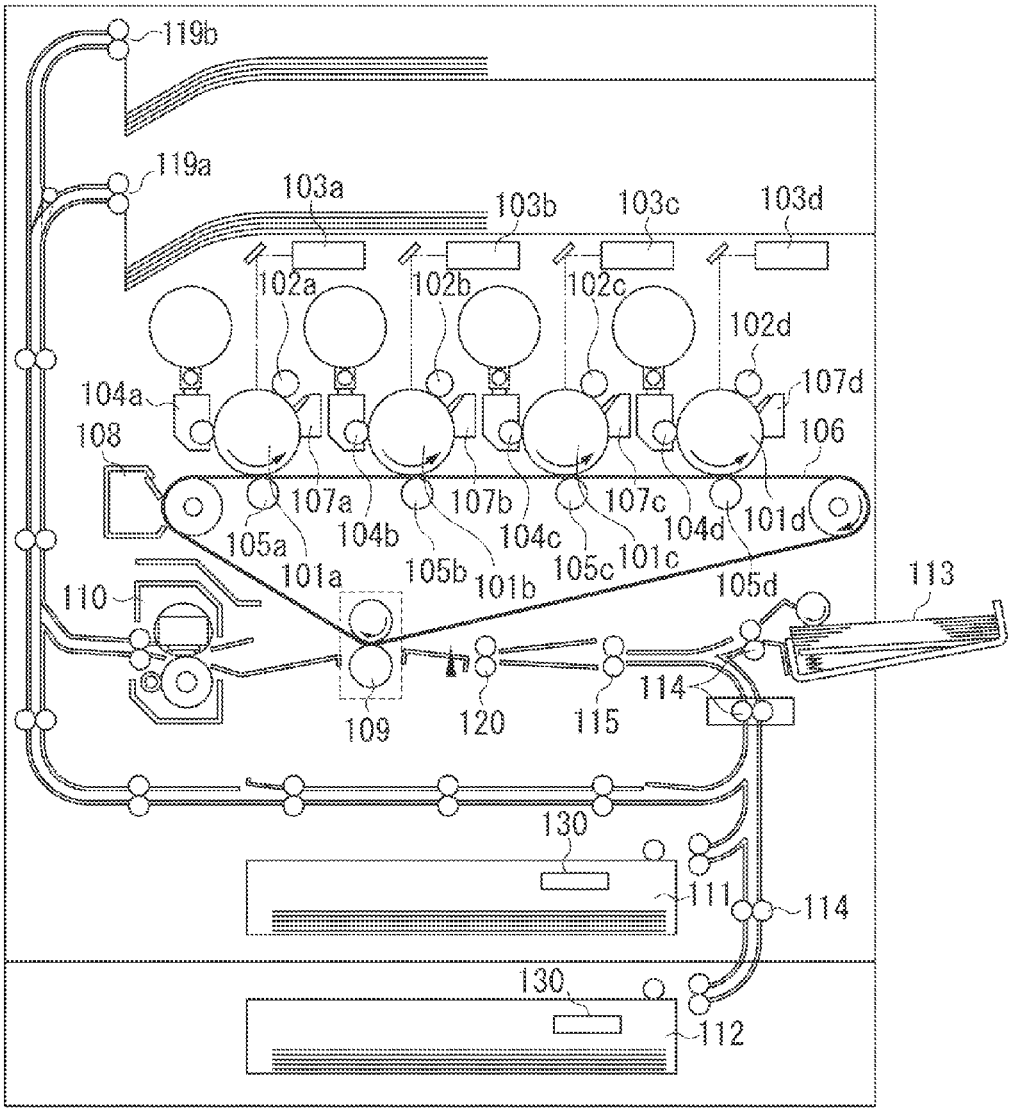
FIG. 10 illustrates a general configuration of the image forming apparatus according to the present exemplary embodiment.

FIG. 10 is a schematic cross-sectional view illustrating a color digital printer as an example of an image forming apparatus, to which a sheet conveyance apparatus according to the present invention is applied.

First, an image forming unit will be described. The surfaces of four photosensitive drums 101*a* through 101*d* are uniformly charged by charging rollers 102*a* through 102*d*, respectively. Image signals of yellow (Y), magenta (M), cyan (C), and black (K) are input to laser scanners 103*a* through 103*d*, respectively. The drum surfaces are irradiated with laser beams in response to the image signals, whereby the electric charges are neutralized and latent images are formed.

The latent images formed on the photosensitive drums 101*a* through 101*d* are developed with yellow, magenta, cyan, and black tonners, respectively, by the development units 104*a* through 104*d*. The tonner images developed on the photosensitive drums 101*a* through 101*d* are sequentially transferred onto an intermediate transfer belt 106 serving as an image bearing member in the form of an endless belt by primary transfer rollers 105*a* through 105*d*, respectively, and a full-color tonner image is formed on the intermediate transfer belt 106.

A sheet fed from one of sheet feeding cassettes 111 and 112 which store sheets is conveyed toward a registration roller pair 120 by a conveyance roller pair 115. Further, a sheet fed from a manual feed unit 113 is conveyed to the registration roller pair 120. The tonner image formed on the intermediate transfer belt 106 is controlled such that no misregistration occurs between the sheet conveyed by the registration roller pair 120 and the image. The tonner image is transferred onto the sheet by a secondary transfer roller 109. Thereafter, the tonner image is heated and pressed by a fixing device 110 to be fixed onto the sheet. Thereafter, the sheet is discharged to the exterior of the apparatus main body via a discharge unit 119*a* or 119*b*.

Further, various types of information relating to the sheets (size information, grammage information, information of surface property, etc.) are set so that the information can be input by a user to the control unit as will be described below from an operation unit 200 (illustrated in FIG. 3) provided in the image forming apparatus. Furthermore, various types of information relating to the sheets is set so that they can be input to the control unit as will be described below from a computer 201 connected via a network.

In the sheet feeding cassettes 111 and 112, there is provided a size detection mechanism 130 for detecting a size of stored sheets to cause the control unit as will be described below of the image forming apparatus to recognize the size. The size detection mechanism 130 has a rotatable size detecting lever that comes into sliding-contact and interlocking with a side regulating plate for regulating a position in the width direction of the sheet. The side regulating plate is movable in alignment with a side end portion of the sheet, and a position in the width direction of the sheet can be aligned with respect to the image forming unit.

The size detection mechanism 130 is provided with a plurality of sensors or switches arranged at a position corresponding to the size detecting lever, in a mounting unit of the apparatus main body where each of the sheet feeding cassettes 111 and 112 is mounted. Consequently, when the side regulating plate is moved in alignment with the side end portion of the sheet, the size detecting lever rotates interlockingly. When the feeding sheet cassette is mounted on the image forming apparatus, the size detecting lever selectively turns ON/OFF detecting elements of the sensors or switches arranged in the mounting unit of the apparatus main body. Accordingly, signals of different patterns from the sensors or switches are sent to the image forming apparatus main body. Then, the image forming apparatus can recognize a size of the sheets stored in the sheet feeding cassette based on the signal. As the size detection mechanism, a similar mechanism may be provided in the manual feed unit 113.

The side regulating plate has a function of preventing the skew of the sheet and a positional deviation in the width direction. Actually, however, when a slight gap (play) between the side regulating plate and the sheet is produced, the skew of the sheet and the positional deviation in the width direction may be produced in some cases. Furthermore, the sheet fed from the sheet feeding unit may be skewed, and a position in the width direction may be deviated during conveyance.

Consequently, the image forming apparatus according to the present exemplary embodiment is provided with the sheet conveyance apparatus that corrects the skew of the sheet. The sheet conveyance apparatus, as illustrated in schematic top views in FIGS. 5A, 5B, 5C, 5D, and 5E, causes a leading edge of the sheet which has been conveyed to contact a nip portion of the registration roller pair 120 being at a stop, and aligns the leading edge of the sheet along the nip portion while forming a loop on the sheet, thereby correcting the skew of the sheet. At that time, a sheet loop amount formed on the sheet needs to allow the leading edge of the sheet to contact the nip portion of the registration roller pair 120 with reliability and to allow the leading edge of the sheet to align along the nip portion. Consequently, a loop in a proper amount is formed on the sheet by performing feeding of the sheet by a predetermined amount by the conveyance roller pair 115 arranged upstream of the registration roller pair 120, after the sheet has passed through a registration sensor 141.

A contact image sensor (CIS) 143 as a width-direction detection unit for detecting a position in the width direction (a direction orthogonal to the sheet conveyance direction) of the sheet is arranged between the registration roller pair 120 and the secondary transfer unit 109. The CIS 143 detects a position in the width direction of the sheet being conveyed by the registration roller pair 120. The control unit described below calculates a deviation amount between a detection result of the CIS 143 and a nominal position. Then, by shifting the registration roller pair 120 in the width direction based on the calculated deviation amount, a position in the width direction of the sheet is corrected to coincide with a position of an image to be transferred by the image forming unit.

Figure 1:
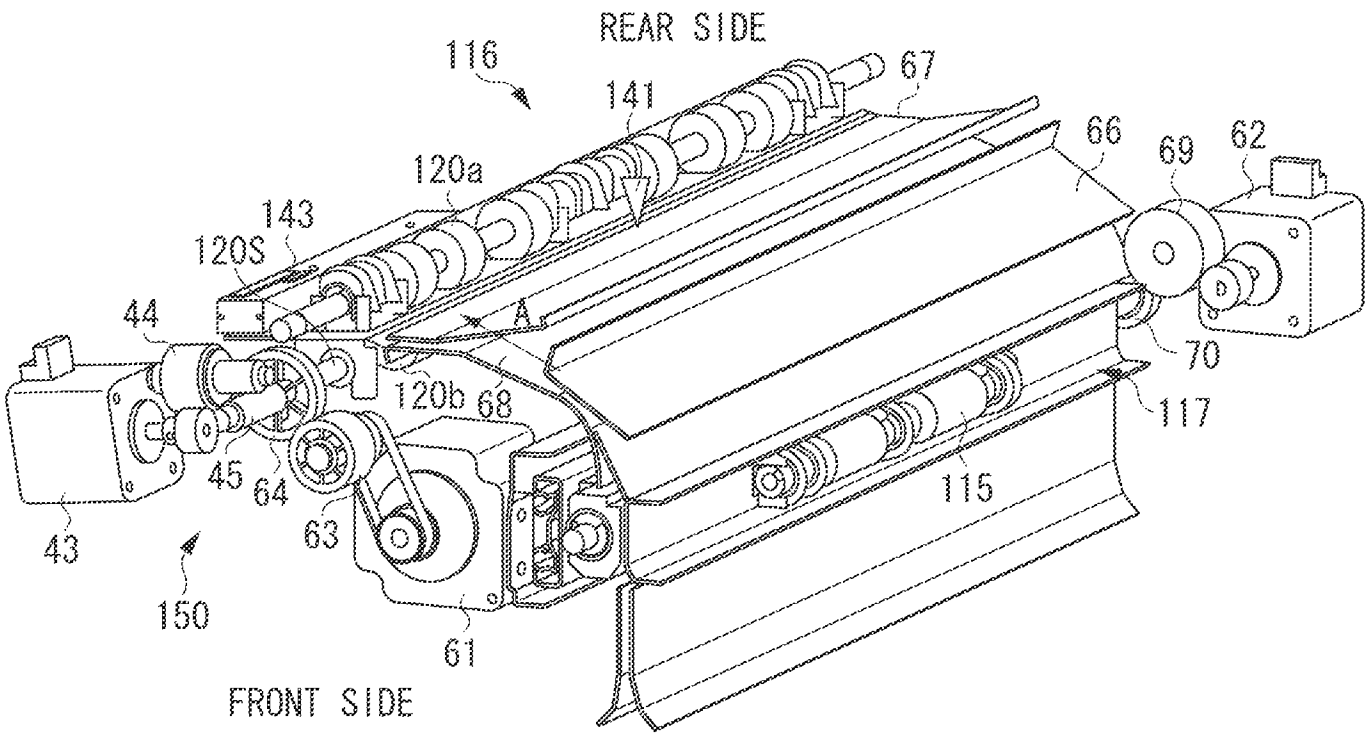
FIG. 1 illustrates a sheet conveyance apparatus according to a first exemplary embodiment of the present invention.

Next, the sheet conveyance apparatus according to a first exemplary embodiment of the present invention will be described with reference to the drawings. FIG. 1 is a perspective view of a sheet conveyance apparatus 116 provided on the way of a sheet conveyance path connecting the sheet feeding cassettes 111, 112 and the image forming unit. The sheet conveyance apparatus 116 according to the first exemplary embodiment of the present invention performs skew correction of the sheet and position adjustment in the width direction of the sheet.

Figure 2A:
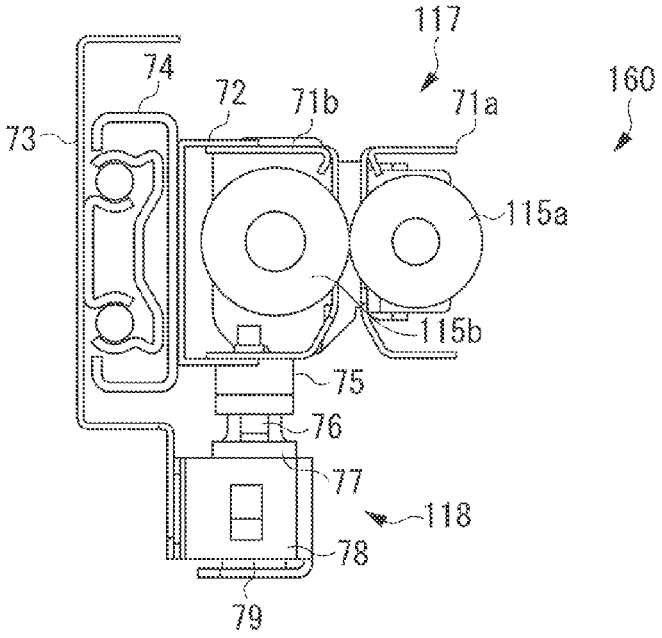
FIGS. 2A and 2B illustrate a conveyance roller pair movement mechanism.
Figure 2B:
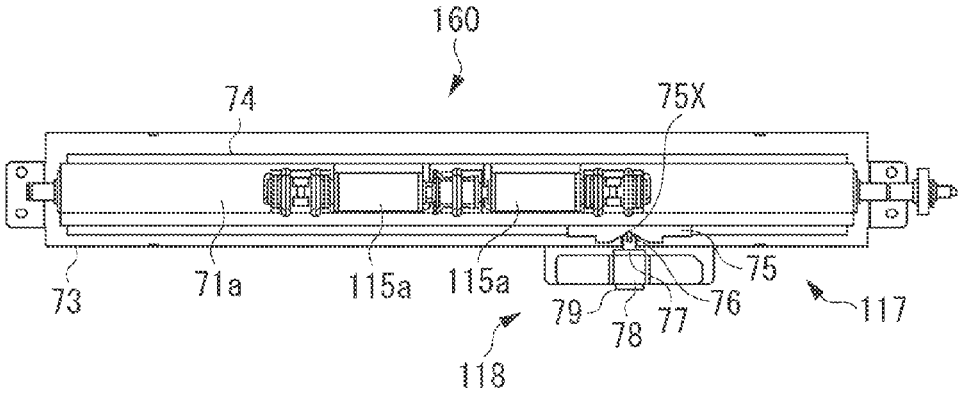

The conveyance roller pair 115 arranged on the sheet conveyance path, as illustrated in FIGS. 2A and 2B, is configured such that a driven roller 115*a* having a roller made of polyacetal (polyoxymethylene(POM)) and a drive roller 115*b* formed of a rubber roller are arranged opposed to each other. Then, the driven roller 115*a* is swingably supported by a lever or the like, and is in press-contact with the drive roller 115*b* by an elastic force of springs (not illustrated).

The registration roller pair 120, as a downstream roller pair that conveys the sheet while nipping the sheet, arranged downstream of the conveyance roller pair 115, is provided with a driven roller 120*a* and a drive roller 120*b* as illustrated in FIG. 1. Further, in the present exemplary embodiment, the leading edge of the conveyed sheet contacts a nip portion (a contacting portion) between the driven roller 120*a* and the drive roller 120*b*, and the leading edge of the sheet is aligned along the nip portion that corrects the skew of the sheet. The driven roller 120*a* of the registration roller pair 120 includes a roller made of polyacetal (POM) while the drive roller 120*b* is formed of a rubber roller, and the driven roller 120*a* and the drive roller 120*b* are arranged opposed to each other. Further, the driven roller 120*a* is swingably supported by a lever or the like, and the driven roller 120*a* is in press-contact with the drive roller 120*b* by an elastic force of springs (not illustrated).

In FIG. 1, a conveyance roller drive motor 62 serves as a conveyance roller driving unit for driving the first drive roller 115*b* of the conveyance roller pair 115. A registration motor 61 serves as a registration driving unit for driving the drive roller 120*b* of the registration roller pair 120.

Next, a width-direction correction unit 150 (a downstream roller pair movement unit) that corrects a position in the width direction of the sheet by moving the registration roller pair 120 in the width direction of the sheet will be described.

The drive roller 120*b* of the registration roller pair 120 is fixed to a registration roller rotating shaft 120S, and the registration roller rotating shaft 120S is mounted on the apparatus main body to be movable in the width direction of the sheet. Then, along with movement of the registration roller rotating shaft 120S in the width direction of the sheet, the driven roller 120*a* and the drive roller 120*b* move integrally with each other in the width direction of the sheet.

The width-direction correction unit 150 includes a pinion gear 44 and a rack 45. The rack 45 is supported by the registration roller rotating shaft 120S in such a manner as to be rotatable in the rotational direction and fixed in the width direction of the sheet.

By the configuration, when a shift motor 43 as a width-direction correction unit driving unit is driven, the pinion gear 44 is rotated, and the rack 45 moves in the width direction of the sheet. Accordingly, movement of the registration roller pair 120 in the width direction of the sheet is performed, and the sheet nipped by the registration roller pair 120 can be moved in the width direction. As compared with a registration roller input gear 64, a registration roller idler gear 63 has a larger tooth width. This is for the purpose of maintaining mesh engagement of the gears to enable rotation of the registration roller pair 120, even in a case where the registration roller pair 120 and the registration roller input gear 64 have moved in the width direction.

On the downstream side of the registration roller pair 120, there is provided the CIS 143 as a detection unit that detects a position of side end portion of the sheet. Further, the CIS 143 is arranged upstream side of an image transfer unit, and, in the width direction of the sheet, is arranged so as to be nearer to one side from the center. This is because detection of the side end portion of one side of the sheet is sufficient. Further, the CIS 143 has a length in the width direction which is set so that a sheet with a minimum width and a sheet with a maximum width can be detected.

Next, a conveyance roller pair movement mechanism 160 will be described with reference to FIGS. 2A and 2B. FIG. 2A is a cross-sectional view when the conveyance roller pair movement mechanism 160 is viewed from the main body front side. FIG. 2B is a view when the conveyance roller pair movement mechanism 160 is viewed from the main body right-hand side. The main body front side is on the near side in a vertical direction of sheet surface in FIG. 10 illustrating the image forming apparatus, and the main body right-hand side is a rightward direction in FIG. 10.

The conveyance roller pair movement mechanism 160 holds the conveyance roller pair 115 movable in the width direction so as to follow movement in the width direction of the sheet while nipping the sheet. Further, the conveyance roller pair movement mechanism 160 conveys, toward the downstream side, the sheet nipped by the conveyance roller pair 115. When the sheet passes through the nip portion of the conveyance roller pair 115 and a force from the sheet is released, the conveyance roller pair movement mechanism 160 returns the conveyance roller pair 115, which has moved in the width direction, to the home position.

The conveyance roller pair movement mechanism 160 is provided with a conveyance roller unit 117 that supports the conveyance roller pair 115, a slide rail 74 serving as a movement supporting portion that supports the conveyance roller unit 117 in a slidable manner, and a central urging mechanism 118 that urges the conveyance roller unit 117 toward the home position. The movement supporting portion may employ any configuration as long as it is a configuration in which the conveyance roller unit 117 is slidable in a smooth manner. For example, a configuration including a groove extending in the width direction and a rib which slides in the groove may be also employed. Further, the home position of the conveyance roller pair 115 and the home position of the conveyance roller unit 117 are in the same state.

A configuration of the conveyance roller unit 117 will be described. The conveyance roller unit 117 is provided with the conveyance roller 115, a conveyance lower guide 71*b* that rotatably supports the drive roller 115*b* of the conveyance roller 115, and a conveyance upper guide 71*a* that rotatably supports the driven roller 115*a*. The conveyance lower guide 71*b* and the conveyance upper guide 71*a* are fixed to each other. A strengthening plate 72 is fixed to the conveyance lower guide 71*b*.

The slide rail 74 is provided between the conveyance roller unit 117 and a stay 73 fixed to the apparatus main body, and the conveyance roller unit 117 slides on the slide rail 74. Accordingly, the conveyance roller pair 115 provided in the conveyance roller unit 117 becomes able to slide in the width direction with a very small slide resistance with respect to the apparatus main body, while following the sheet nipped by the conveyance roller pair 115.

The conveyance roller idler gear 70 has a larger tooth width as compared with that of the conveyance roller input gear 69. This is for the purpose of enabling rotations of the drive roller 115*b* of the conveyance roller 115 by maintaining mesh engagement of the gears to enable transmission of the drive, even when the conveyance roller 115 has thrustingly moved in the width direction.

Next, the central urging mechanism 118 for returning the conveyance roller unit 117 that has moved while following the sheet to the home position (a central position) will be described. As illustrated in FIG. 2A and FIG. 2B, the central urging mechanism 118 is provided with a slide cam 75 provided with a first inclined surface 75*a* and a second inclined surface 75*b* as cam surfaces, and a pressing roller 76 as a pressing member that comes into contact with the cam surface of the slide cam 75 and rotatably supported by a roller holder 77. Further, the central urging mechanism 118 is provided with an elastic member 79, such as a spring or the like, as an urging member that urges the pressing roller 76 against the slide cam 75. As the pressing member, a member in a spherical shape or the like rotatably supported may be used other than a roller in a roller shape rotatably supported, and a configuration of rolling along the cam surface is better when a frictional resistance is taken into account.

As illustrated in schematic cross-sectional views in FIGS. 5A, 5B, 5C, 5D, and 5E, in the present exemplary embodiment, the slide cam 75 is fixed to the conveyance roller unit 117. Further, the roller holder 77 that supports the pressing roller 76 is supported in a slidable manner by a roller holder guide 78 fixed to the stay 73 on the apparatus main body side. Further, the elastic member 79 described above is provided between the stay 73 on the apparatus main body side and the roller holder 77.

Then, a configuration in which the pressing roller 76 urged by the elastic member 79 presses the slide cam 75 is employed. The roller holder 77 is held slidably in a direction away from the slide cam 75, namely, in a direction orthogonal to the width direction, by the roller holder guide 78. The inclined surfaces 75*a* and 75*b* of the slide cam 75 have a left-right symmetrical shape with respect to a neutral point 75X. Then, when the conveyance roller unit 117 has slid in the width direction, the pressing roller 76 can return the slide cam 75 to the central position by exerting an urging force from the elastic member 79 to one of the first and second inclined surfaces 75*a* and 75*b* of the slide cam 75.

Next, the central urging mechanism 118 will be described in detail with reference to FIGS. 7A and 7B.

Figure 5A:
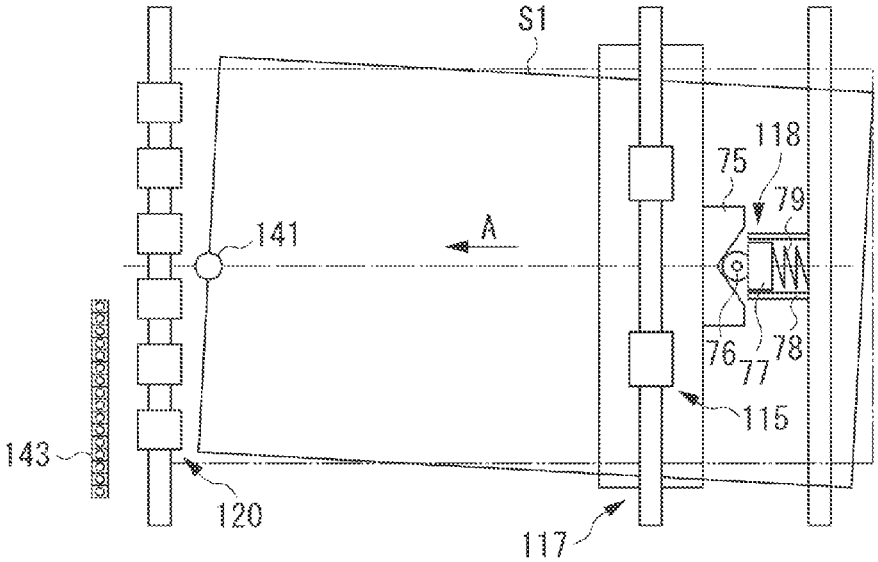
FIGS. 5A, 5B, 5C, 5D, and 5E are top perspective views illustrating the sheet skew correction and positional correction operation according to the present exemplary embodiment.
Figure 7A:
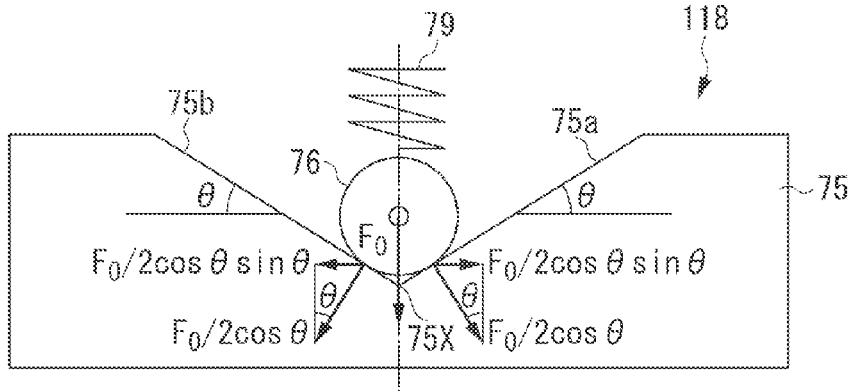
FIGS. 7A and 7B are diagrams illustrating a central urging mechanism.
Figure 7B:
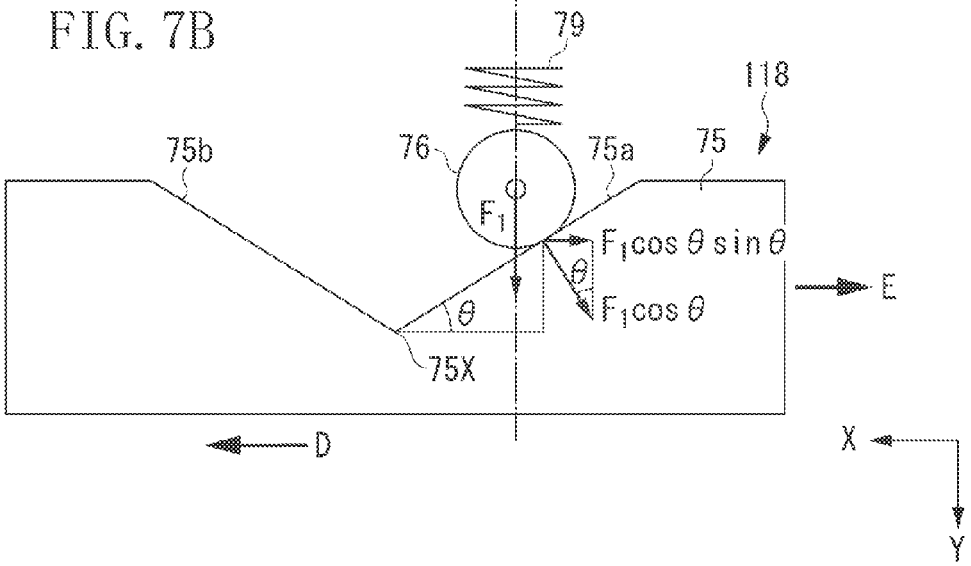

FIG. 7A illustrates a state where the conveyance roller unit 117 (the conveyance roller pair 115) is in the home position, that is, a state where the slide cam 75 provided integrally with the conveyance roller unit 117 is in the home position (equivalent to FIG. 5A). Further, FIG. 7B illustrates a state where the conveyance roller unit 117 has moved from the home position, that is, a state where the slide cam 75 has moved (in FIG. 7B, moved in a direction indicated by an arrow D) (equivalent to FIG. 5D). Horizontal directions in FIGS. 7A and 7B are indicated as X, and the left direction is defined as a plus. Vertical directions in FIGS. 7A and 7B are indicated as Y, and downward direction is defined as the plus.

As illustrated in FIG. 7A, in a case where the conveyance roller unit 117 is in the home position, the pressing roller 76 urged in the Y-direction by the elastic member 79 is in contact with both the first inclined surface 75*a* and the second inclined surface 75*b* of the slide cam 75. The first inclined surface 75*a* and the second inclined surface 75*b* are surfaces inclined relative to the width direction of the sheet and a direction orthogonal to the width direction. If an urging force in the Y-direction to the pressing roller 76 by the elastic member 79 is indicated as $F_0$, a force (the same force) of $F_0/2 \cos\theta \sin\theta$ acts on the first inclined surface 75*a* of the slide cam 75 in a minus direction of an X-axis and on the second inclined surface 75*b* in a plus direction of the X-axis. Accordingly, plus and minus forces in X-direction are balanced, so that the slide cam 75 remains at rest and the conveyance roller unit 117 is urged toward the central position and is maintained in a stopped state.

When a force in the width direction impressed on the sheet nipped by the conveyance roller pair 115 exceeds $F_0/2 \cos\theta \sin\theta$, the slide cam 75 slides in the width direction (in FIG. 7A, a left-right direction). For example, as illustrated in FIG. 7B, in a case where the conveyance roller unit 117 moves in a direction indicated by an arrow "D" (a plus direction in the X-direction) while following the sheet, the slide cam 75 also moves in the "D" direction. Accordingly, the pressing roller 76 rotates on the first inclined surface 75*a* of the slide cam 75, the elastic member 79 is compressed, and an urging force $F_1$ that urges the pressing roller 76 in the plus direction of the Y-axis becomes larger than $F_0$. At that time, since the pressing roller 76 is in contact with only the first inclined surface 75*a* of the slide cam 75 and is not contact with the second inclined surface 75*b*, a force of $F_1 \cos\theta \sin\theta$ acts on the slide cam 75 only in the minus direction of the X-axis. Accordingly, when the slide cam 75 is released from a force in the direction of the arrow "D" applied by the sheet, the slide cam 75 moves in a minus direction (an "E" direction) of the X-axis and is returned to the central position by the force of $F_1 \cos\theta \sin\theta$. In other words, the slide cam 75 receives from the pressing roller 76 only a force in a direction (the "E" direction) reverse to the direction (the "D" direction), to which the slide cam 75 has moved from the home position, and returns to the home position.

Further, even in a case where the conveyance roller unit 117 moves in the minus direction of the X-axis direction (the reverse direction to the "D" direction) while following the sheet, the conveyance roller unit 117 receives only a returning force from the pressing roller 76 in an opposite direction to a direction to which the conveyance roller unit 117 has moved. In other words, when the conveyance roller unit 117 moves in the opposite direction to the D direction, the pressing roller 76 moves away from the first inclined surface 75*a* of the slide cam 75. The conveyance roller unit 117 comes into contact with only the second inclined surface 75*b*, thereby receiving only a force in the "D" direction in the width direction.

As described above, the conveyance roller unit 117, at a position to which the conveyance roller unit 117 has moved while following the sheet, receives only a force in a reverse direction to a direction to which the conveyance roller unit 117 has moved while following the sheet, by the central urging mechanism 118. In this way, the conveyance roller unit 117 can be returned to the home position with reliability by the central urging mechanism 118.

Therefore, according to the present exemplary embodiment, the conveyance roller pair, which has moved from the home position while following the sheet moving in the width direction, can be returned to the home position with reliability.

Next, the skew correction operation and positional correction operation in the width direction by the sheet conveyance apparatus 116 will be described with reference to schematic views of FIGS. 5A, 5B, 5C, 5D, and 5E and FIGS. 6A, 6B, 6C, 6D, and 6E. FIGS. 5A, 5B, 5C, 5D, and 5E are top perspective views, and FIGS. 6A, 6B, 6C, 6D, and 6E are side views, and FIGS. 5A through 5E correspond to FIGS. 6A through 6E, respectively.

As illustrated in FIG. 5A, the skew correction operation in a case where a sheet is skewing leftward with respect to a conveyance direction "A" will be described. In a state of FIG. 5A, the conveyance roller unit 117 is at a central position, which is a home position in a thrust direction. The conveyance roller pair 115 rotates so that the sheet is conveyed in the conveyance direction "A", and a leading edge at the left side in the conveyance direction "A" of the sheet contacts the nip portion of the registration roller pair 120. At that time, the registration roller pair 120 stops rotating.

Figure 5B:
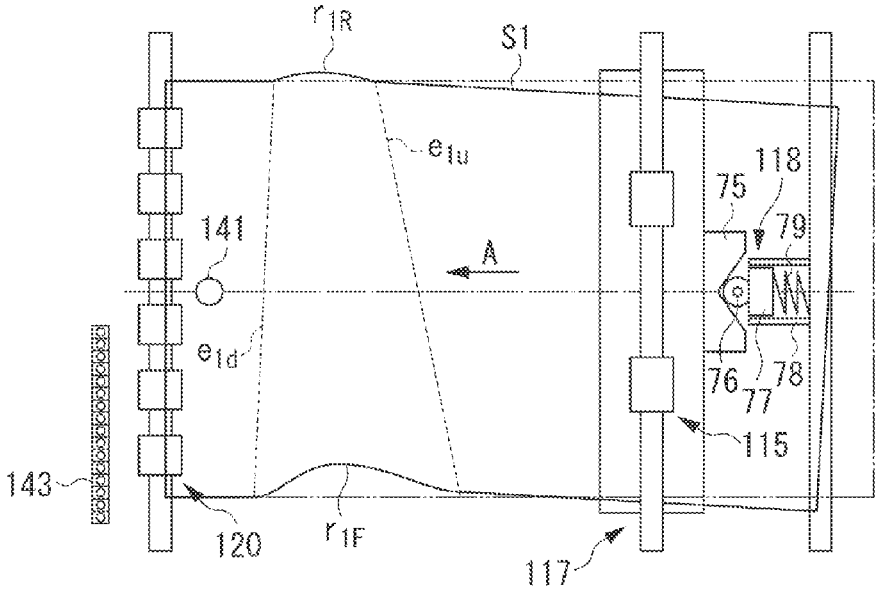
Figure 6A:
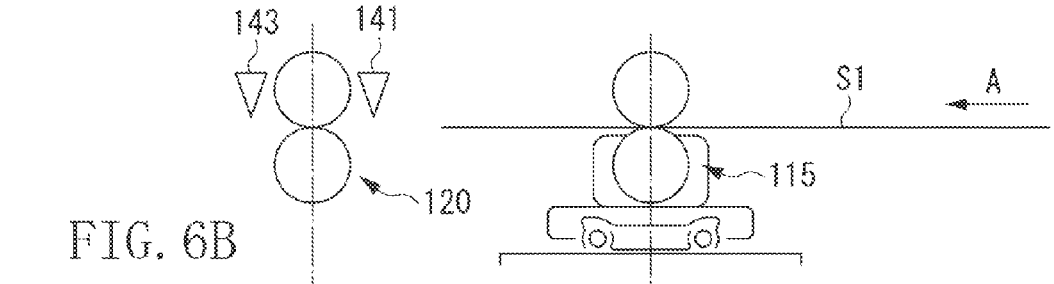
FIGS. 6A, 6B, 6C, 6D, and 6E are side views illustrating the sheet skew correction and positional correction operation in the width direction according to the present exemplary embodiment.
Figure 6B:
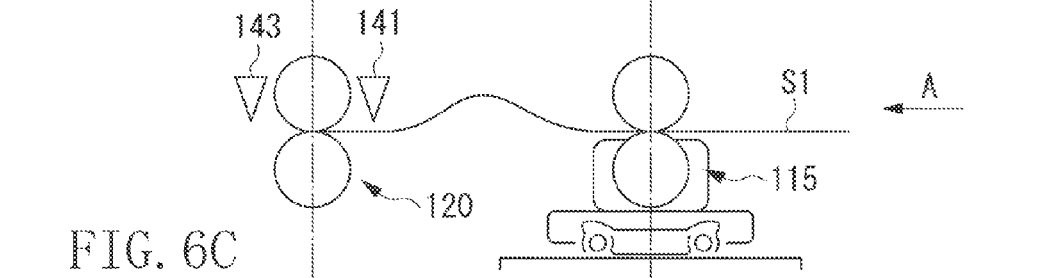

When the conveyance roller pair 115 further rotates, the sheet is conveyed in the conveyance direction "A", as illustrated in FIG. 5B and FIG. 6B, whole area of the leading edge portion in the conveyance direction "A" of the sheet contacts the nip portion of the registration roller pair 120. At that time, a leading corner portion on one side ahead of the other of the skewed sheet contacts the nip portion of the registration roller pair 120 and is stopped. Then, when the sheet is further conveyed, a loop is gradually formed on the sheet, and the leading edge of the sheet rotates so that a corner portion on an opposite side of the corner portion of the sheet, which has contacted the nip portion of the registration roller pair 120, comes close to the nip portion. Then, the loop is formed on the sheet between the registration roller pair 120 and the conveyance roller pair 115. Accordingly, the whole area of the leading edge of the sheet is contacted with the nip portion of the registration roller pair 120 and thereby the skew is corrected.

The loop shape at this time has the following features. The loop size on the front side rear $r_{1F}$ and the loop size on the rear side $r_{1R}$ are unequal to each other, and the loop size on the rear side is smaller ($r_{1F}>r_{1R}$). The edge lines $e_{1d}$ and $e_1$ constituting inflection points in bending are not parallel with each other but are formed in chevron shape, and a twist is generated in the loop. A loop to be formed on the sheet when the apparatus correcting a skew of the sheet is set as appropriate based on the size, grammage, and the like of the sheet (hereinafter, referred to as sheet information).

The controller 50 can determine an optimum loop amount based on sheet information specified by the user in the operation unit 200 or sheet information detected by the size detection mechanism 130, or a combination of the information.

Figure 5C:
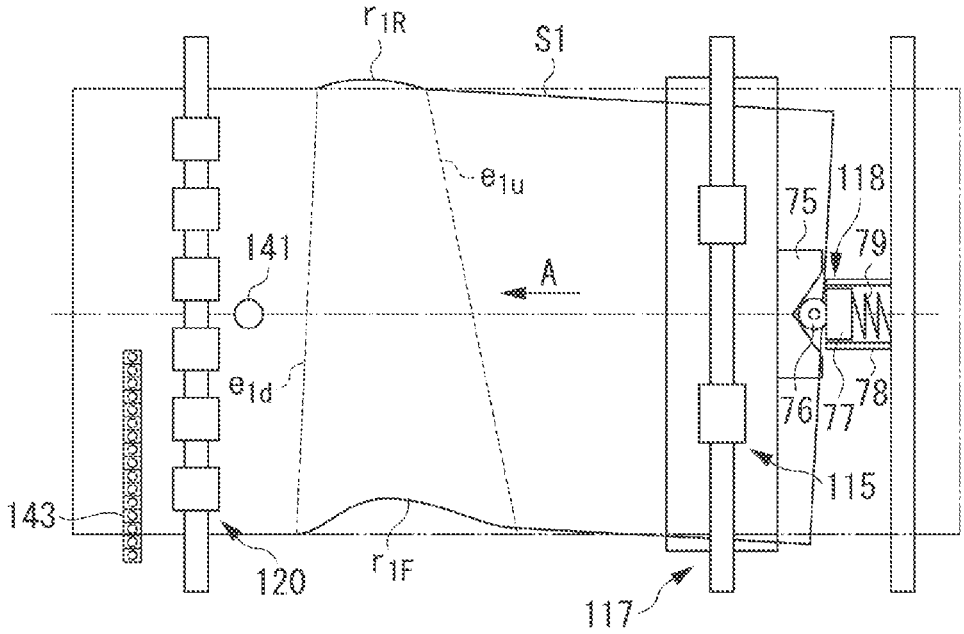
Figure 6C:
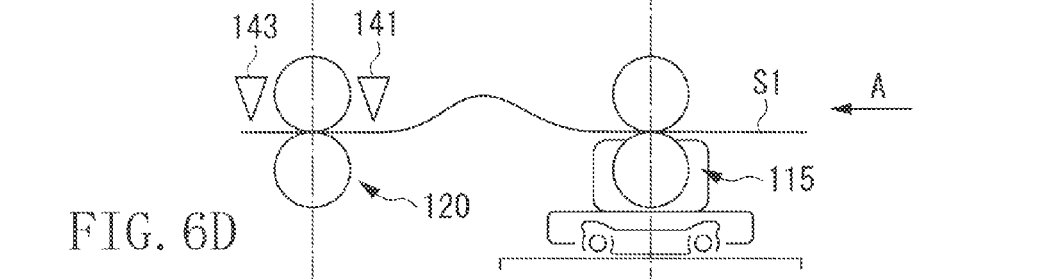

Thereafter, the registration roller pair 120 rotates, and a sheet S1 is conveyed in a state where the skew has been corrected as illustrated in FIG. 5C and FIG. 6C. A side end portion of the sheet being conveyed by the registration roller pair 120 is detected by the CIS 143. The controller 50 controls movement in the width direction of the registration roller pair 120 by the width-direction correction unit 150 based on a detection result of the CIS 143.

Figure 5D:
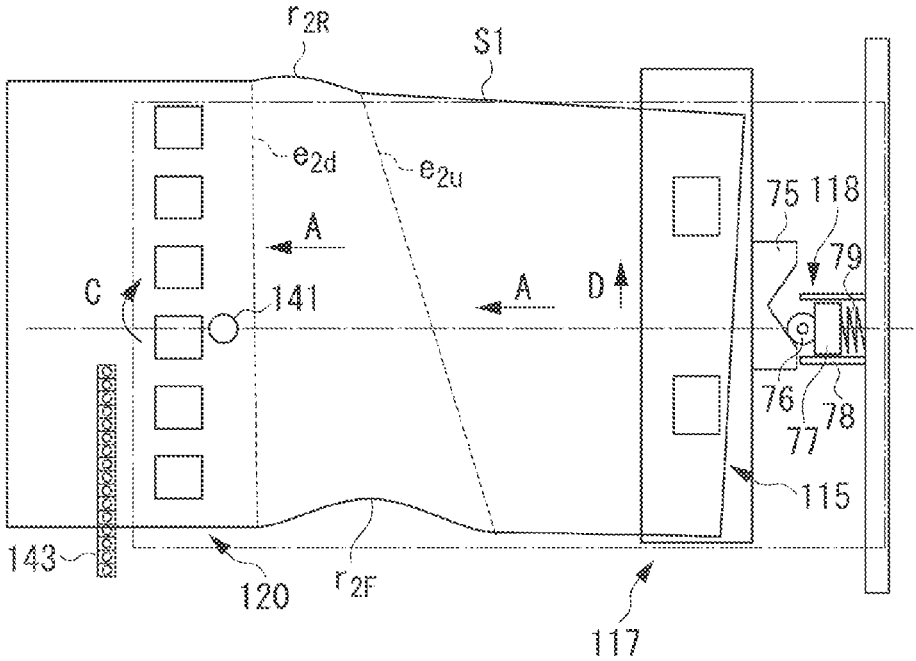
Figure 6D:
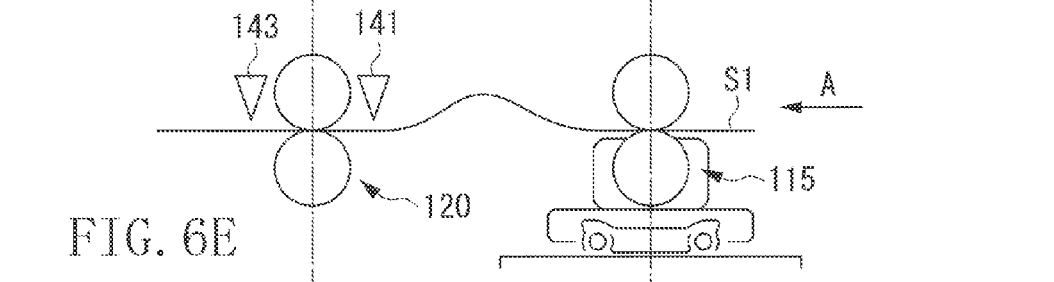

As illustrated in FIG. 5D and FIG. 6D, in a case where the sheet is deviated toward the apparatus front side, the controller 50 moves the registration roller pair 120 toward the apparatus rear side (in the arrow "D" direction) from the home position (an initial position). Then, the sheet nipped by the registration roller pair 120 is also moved in an arrow "C" direction. Suppose that a configuration in which the conveyance roller pair 115 cannot move in the width direction is employed, then the sheet is twisted between the registration roller pair 120 and the conveyance roller pair 115. As a result, the sheet may be skewed, or wrinkles may be produced on the sheet in some cases.

According to the present exemplary embodiment, since the conveyance roller pair 115 can move while following the movement in the width direction of the sheet nipped by the conveyance roller pair 115, occurrence of skew or wrinkles due to the above-described fact that the sheet is twisted can be prevented.

The conveyance roller unit 117 is movable in the width direction with a small slide resistance. Therefore, when the registration roller pair 120 is shifted in the arrow "B" direction, the conveyance roller unit 117 moves in the arrow "D" direction while following the movement of the sheet. Accordingly, as illustrated in FIG. 5D, a twist of the loop formed on the sheet deforms to be absorbed by the movement of the conveyance roller unit 117. Then, when the conveyance further continues in a state where the loop twist is occurred, the conveyance roller unit 117 further moves in the arrow "D" direction.

As illustrated in FIG. 5D, when the conveyance roller pair 115 moves in the arrow "D" direction while following the sheet, the slide cam 75 integral with the conveyance roller unit 117 is deviated from the central position. By the slide cam 75 moving in the width direction, the elastic member 79, which urges the pressing roller 76 of the central urging mechanism 118, is compressed, and a force for urging the conveyance roller unit 117 toward the home position (hereinafter, referred to as a central urging force) becomes large.

Figure 5E:
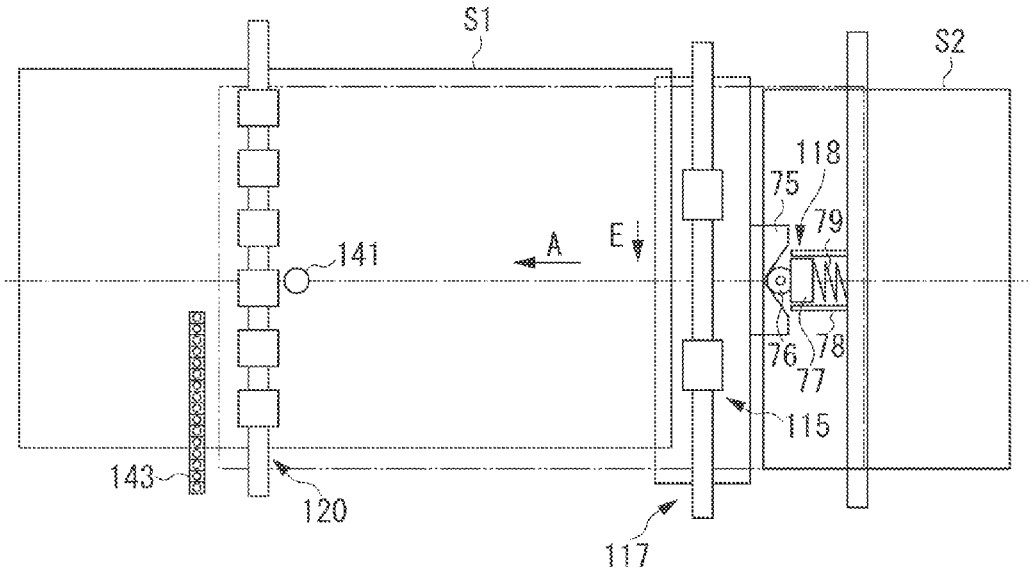
Figure 6E:
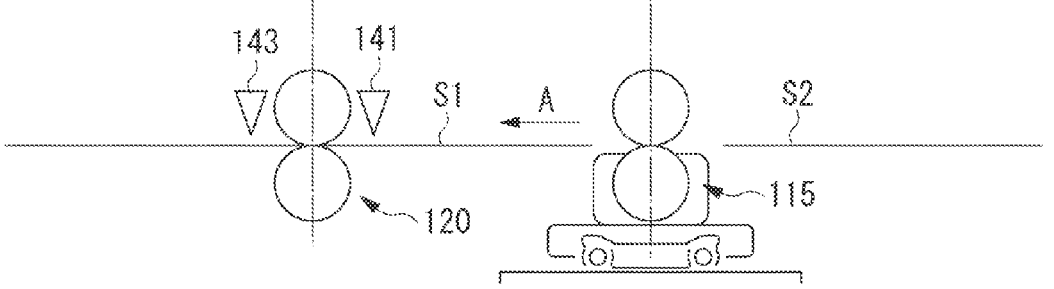

Thereafter, as illustrated in FIG. 5E and FIG. 6E, when a trailing edge of the conveyed sheet S1 escapes from the nip portion of the conveyance roller pair 115, a force for causing the conveyance roller unit 117 to move in the width direction by the sheet is released. Then, with the help of the central urging mechanism 118, the conveyance roller unit 117 moves in an arrow "E" direction from a moved position to which the conveyance roller unit 117 has moved, and returns to the home position before a leading edge of a subsequent sheet S2 reaches the conveyance roller pair 115.

Further, a time taken until the conveyance roller unit 117 returns to the home position from the moved position needs to be made shorter than a time taken until the leading edge of the subsequent sheet S2 reaches the conveyance roller pair 115 after a trailing edge of the preceding sheet S1 has escaped from the conveyance roller pair 115. In this case, when a central urging force is far too large, it becomes hard for the conveyance roller unit 117 becomes to move while following the movement of the sheet. As a result, it is necessary to set the central urging force depending on an apparatus configuration, while taking a nipping force of the registration roller pair 120 or an interval of sheets into consideration.

A control unit of the sheet conveyance apparatus 116 according to the above-described first exemplary embodiment and a flow of the skew correction operation of sheet and width-direction positional correction operation by the control unit will be described with reference to the drawings.

Figure 3:
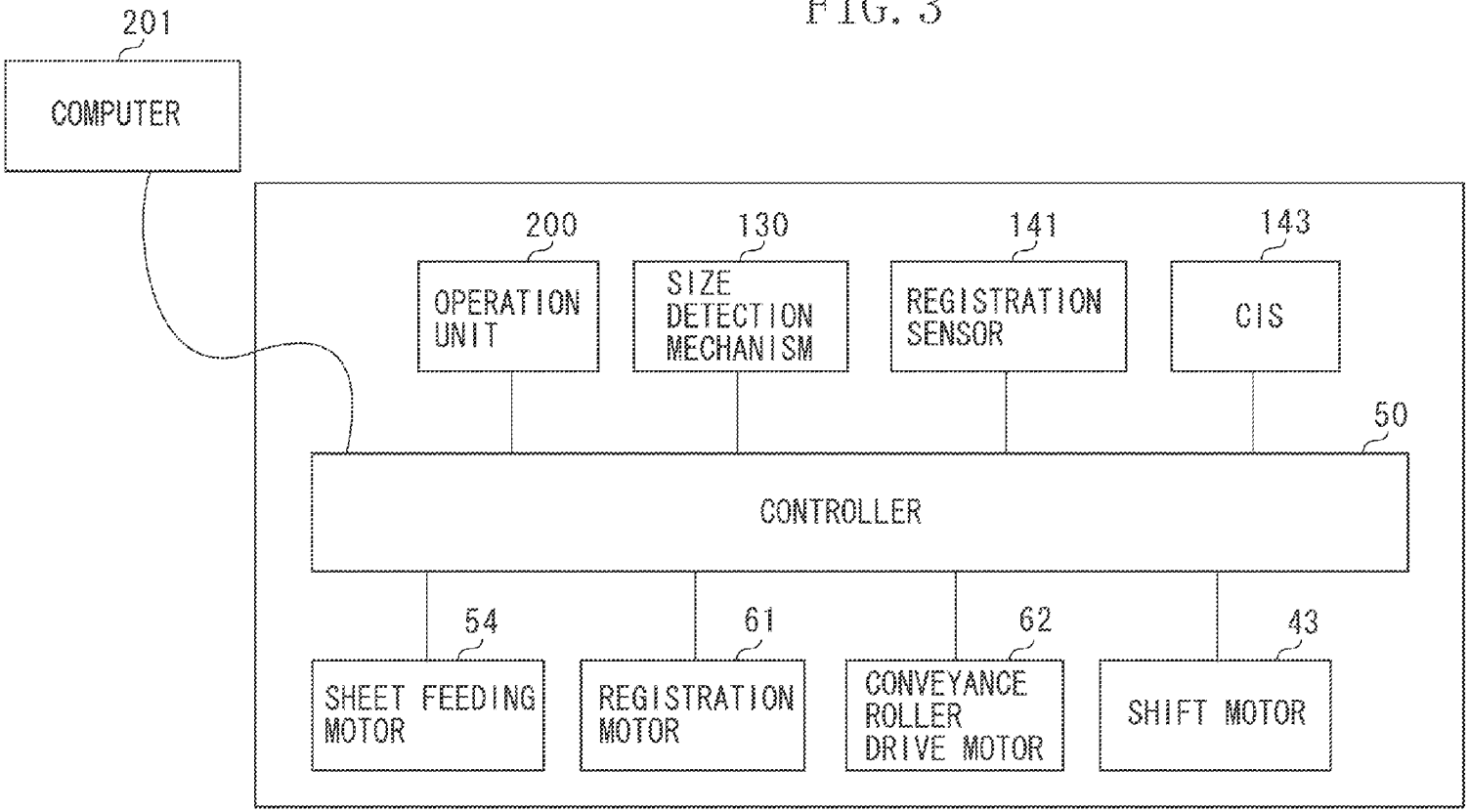
FIG. 3 is a block diagram illustrating an image forming apparatus according to the present exemplary embodiment.

First, as illustrated in the block diagram of FIG. 3, a controller 50 as a control unit is connected to the operation unit 200 and the size detection mechanism 130 of the image forming apparatus. Further, the registration sensor 141, the registration motor 61 as a registration driving unit, a sheet feeding motor 54, the conveyance roller drive motor 62 as a conveyance roller driving unit, the registration roller shift motor 43, and the CIS 143 are connected to the controller 50.

Figure 4:
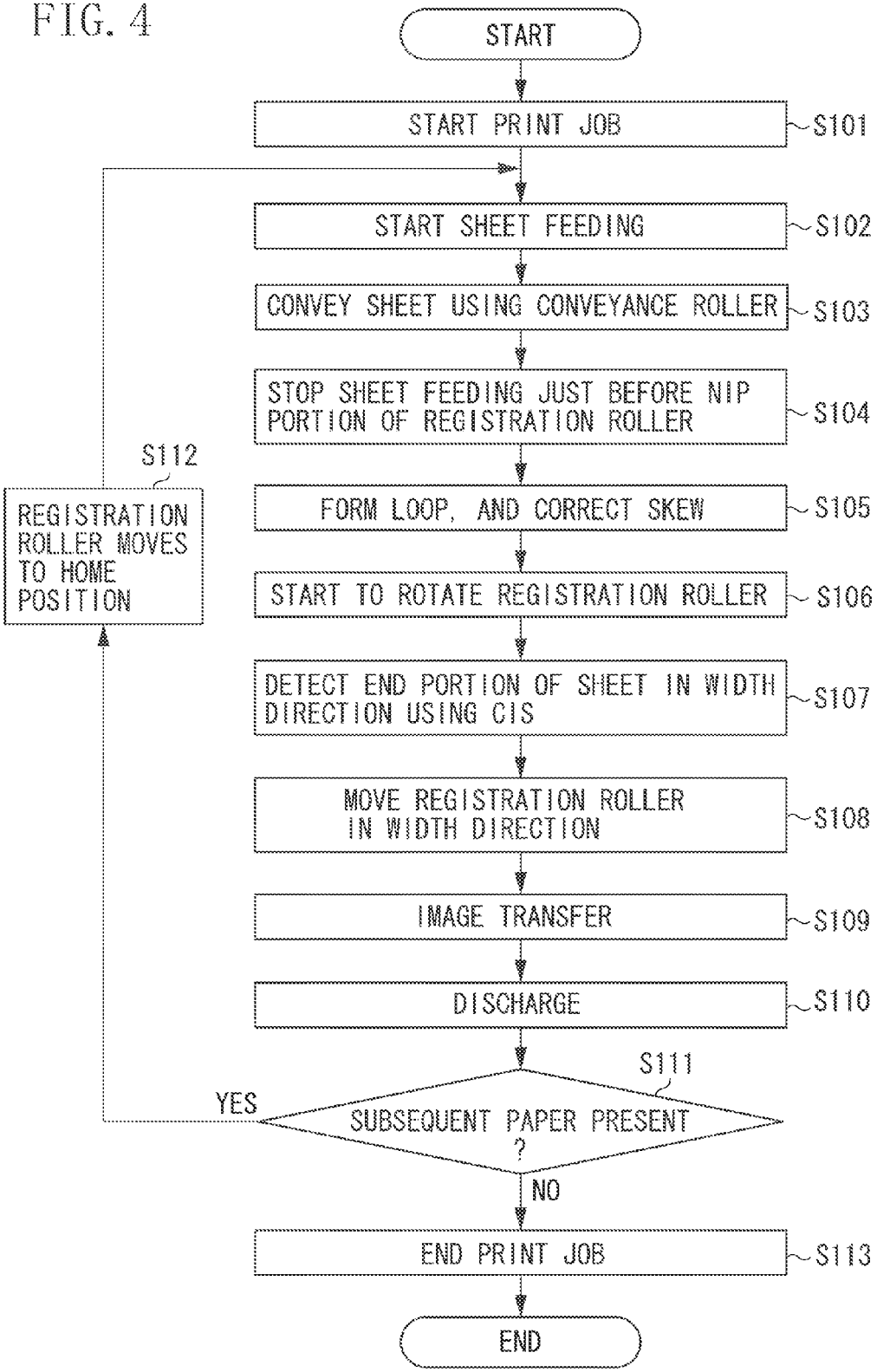
FIG. 4 is a flowchart illustrating sheet skew correction operation and positional correction operation in the width direction of the sheet conveyance apparatus according to the present exemplary embodiment.

A flow of the control performed by the controller 50 will be described with reference to FIG. 4. First, in step S5101, a user executes a print job from the operation unit 200 of the image forming apparatus, or from the computer 201 connected directly or via a network to the image forming apparatus. At that time, the user can specify a number of print copies, as well as sheet information of sheets to be used. Instead, the sheet information may be detected by the size detection mechanism 130.

When the print job is executed, then in step S102, feeding operation of a sheet is started. In step S103, the sheet is conveyed using the conveyance roller pair 115 to the registration sensor 141. When the registration sensor 141 detects the conveyed sheet, in step S104, the conveyance roller pair 115 stops rotating and temporarily causes the sheet to stop just before the nip portion of the registration roller pair 120. This is for the purpose of causing the leading edge the sheet to contact the nip portion of the registration roller pair 120 at a low speed.

The controller 50 stores in advance a table of sheet information and loop amounts formed on the sheets in correspondence with each other. Then, when a skew of the sheet is corrected, the controller 50 refers to the table and determines a loop amount to be formed on the sheet (a conveyance amount of the sheet by the conveyance roller pair 115 for forming a proper loop on the sheet) depending on the sheet information of the conveyed sheet.

Then, in step S105, after a predetermined time has elapsed, the controller 50 controls drive of the conveyance roller drive motor 62, starts rotation of the conveyance roller pair 115, forms a loop on the sheet, and causes the leading edge of the sheet to contact the registration roller pair 120, so as to perform the skew correction operation.

In step S106, when a predetermined amount of loop is formed on the sheet, the controller 50 causes the registration roller pair 120 to forwardly rotate, and the sheet is conveyed toward the downstream side while maintaining a state where the skew has been corrected.

In step S107, when the sheet is conveyed downstream by the registration roller pair 120, a position of an end portion in the width direction of the sheet is detected by the CIS 143.

Thereafter, in step S108, the controller 50 controls the width-direction correction unit 150 based on a detection result by the CIS 143, and causes the registration roller pair 120 to move in the width direction. Accordingly, a position in the width direction of the sheet is corrected to coincide with an image transferred by the image forming unit. The controller 50 calculates a deviation amount in the width direction between a position of the sheet end portion detected by the CIS 143 and a normal position. Then, the controller 50 controls the shift motor 43 so that the registration roller pair 120 is moved in the width direction from the home position by the calculated deviation amount, thereby correcting the position in the width direction of the sheet. The normal position refers to a position of the end portion of the sheet in a case where the sheet is conveyed without a position in the width direction being deviated, and is determined with respect to each of sizes of the sheets. The controller 50 stores in advance a table, in which respective sheet sizes and normal positions of end portions in the width direction of the sheets are corresponded with each other. Then, the controller 50 determines a movement amount of the registration roller pair 120 in the width direction of the sheet depending on a position of end portion in the width direction of the sheet detected by the CIS 143, while referring to the table.

When the registration roller pair 120 moves in the width direction in order to correct a position in the width direction of the sheet, the conveyance roller pair 115 moves in the width direction while following the movement of the sheet. Occurrence of twist, skew, or wrinkles of the sheet can be prevented by the conveyance roller pair 115 moving while following the sheet, which moves while being nipped by the registration roller pair 120. Then, when a trailing edge of the conveyed sheet escapes from the nip portion of the conveyance roller pair 115, the conveyance roller pair 115 returns to the home position from the moved position by an action of the central urging mechanism 118 and can receive the subsequent sheet at a right position.

Then, in step S109, the sheet, the position of which in the width direction has been corrected, is conveyed toward a secondary transfer unit, and an image transfer onto the sheet is performed. In step S110, the sheet is discharged.

Then, in step S111, it is determined whether the subsequent sheet is present. If the subsequent sheet is present (YES in step S111), then in step S112, the registration roller pair 120 is driven by the shift motor 43 and is moved to the home position. If the subsequent sheet is not present (NO in step S111), then in step S113, the print job ends.

Figure 8:
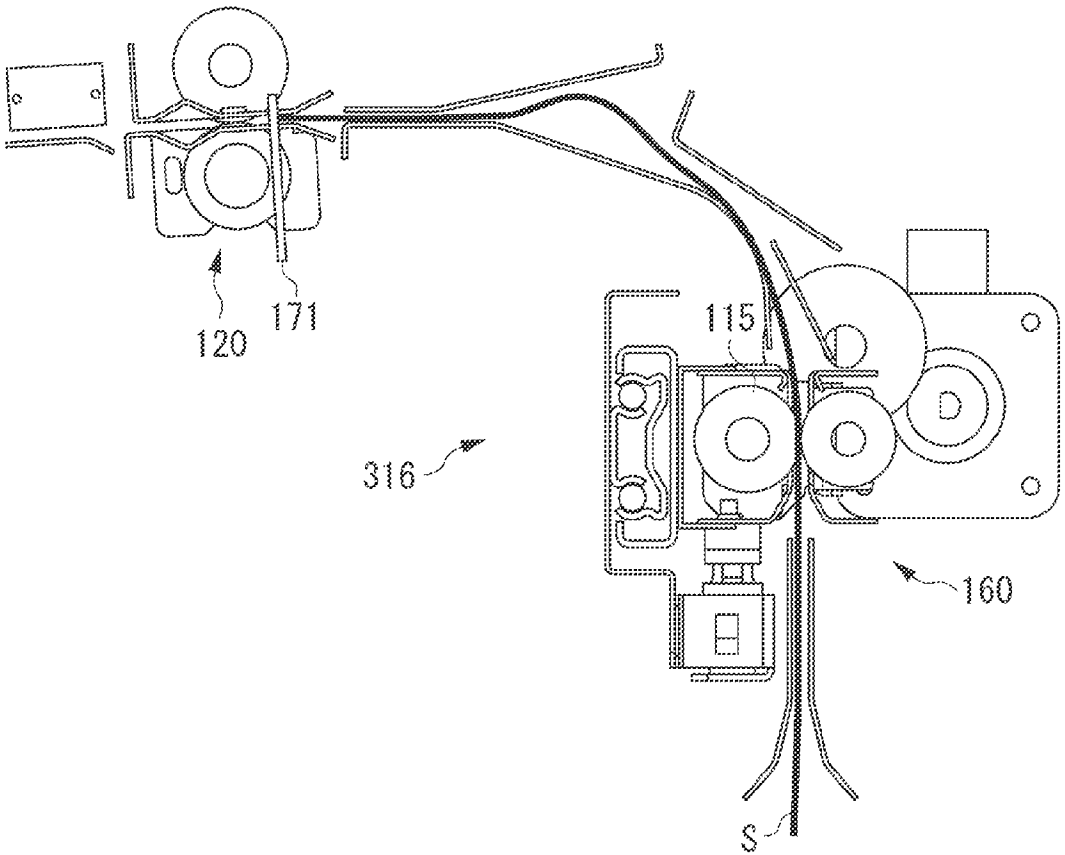
FIG. 8 illustrates a sheet conveyance apparatus according to a second exemplary embodiment of the present invention.

Next, a second exemplary embodiment of the present invention will be described. FIG. 8 is a side view illustrating a sheet conveyance apparatus 316 according to the second exemplary embodiment of the present invention. The second exemplary embodiment differs from the first exemplary embodiment only in that the sheet conveyance apparatus 316 has a shutter member 171 as a contacting portion. Other configurations are the same as the first exemplary embodiment, and, therefore, descriptions of the configurations will not be repeated.

In the first exemplary embodiment, skew is corrected by causing the leading edge of the sheet to contact the nip portion of the registration roller pair 120 being at a stop, while, in the second exemplary embodiment, skew correction is performed by causing the leading edge of the sheet to contact the shutter member 171 in a planar shape.

In the second exemplary embodiment, the shutter member 171 is arranged downstream of the conveyance roller pair 115 and upstream of the registration roller pair 120. The shutter member 171 is protruded into or retracted from the conveyance path by a driving unit (not illustrated). When the shutter member 171 is protruded into the conveyance path, the leading edge of the conveyed sheet contacts the shutter member 171, thereby correcting the skew of the sheet. Thereafter, the shutter member 171 is retracted from the conveyance path, and the sheet is conveyed to the registration roller pair 120. Thereafter, the sheet is conveyed to the image forming unit. The registration roller pair 120 is different from that in the above-described exemplary embodiment, that is, the registration roller pair 120 only conveys the conveyed sheet to the image forming unit and is not required to stop conveyance to form a loop on the sheet.

The shutter member 171 may be arranged downstream of the registration roller pair 120. In this case, a separating mechanism for causing the registration roller pair 120 to separate from each other and to bring into press-contact with each other becomes necessary. More specifically, when the leading edge of the sheet contacts the shutter member 171, the registration roller pair 120 separates from each other. Then, after the loop has been formed on the sheet and the skew correction is completed, the registration roller pair 120 is brought into press-contact with each other to nip the sheet. After the shutter member 171 is retracted, the registration roller pair 120 starts rotating and the sheet is conveyed to the image forming unit.

Next, a third exemplary embodiment of the present invention will be described. In the descriptions of the above exemplary embodiments, a configuration for moving the registration roller pair 120 in the width direction by the width-direction correction unit 150 has been described. On the other hand, in the present exemplary embodiment, the exemplary embodiments of the present invention are also applied to an apparatus, which is not provided with the width-direction correction unit 150 as well.

That is, the present invention is characterized in that the conveyance roller pair 115 is made movable in the width direction to follow the sheet, and the conveyance roller pair 115 which has moved is to be returned to the home position with reliability. Therefore, mechanisms and causes for moving the sheet in the width direction are not limited. For example, when the skew of the sheet is corrected, the leading edge of the sheet nipped and conveyed by the conveyance roller pair 115 contacts the contacting portion, such as the nip portion of the registration roller pair 120 and the shutter member 171, and thereby the skew is corrected. When the leading edge of the skewed sheet contacts the contacting portion and is aligned along the contacting portion, the sheet intends to rotate and the trailing edge side of the sheet intends to move in the width direction. As a result, the rotating ability can be enhanced by configuring the conveyance roller pair 115 to be movable in the width direction using the configurations of the present invention.

In this way, at the time of rotating of the sheet when the leading edge of the sheet contacts the nip portion of the registration roller pair 120 according to the first exemplary embodiment, and the leading edge of the sheet contacts the shutter member 171 according to the second exemplary embodiment, the conveyance roller pair 115 is allowed to follow the sheet.

Hereinbelow, modified examples of the present invention will be described. In the descriptions of the above exemplary embodiments, a configuration in which the slide cam 75 is fixed to the conveyance roller unit 117 and the pressing roller 76 is fixed to the apparatus main body has been described, but the exemplary embodiments of the present invention are not limited to this. In the exemplary embodiments of the present invention, it is only necessary that the slide cam is connected to one of the apparatus main body and the conveyance roller pair, and the pressing roller 76 is connected to the other. Therefore, the slide cam 75 may be fixed to the apparatus main body, and the pressing roller 76 may be fixed to the conveyance roller unit 117.

In the descriptions of the above-described exemplary embodiments, a configuration for urging the pressing roller 76 against the slide cam 75 by the elastic member 79 has been described, but the exemplary embodiments of the present invention are not limited to this. A configuration for supporting the slide cam 75 movable in a direction orthogonal to the width direction and urging the slide cam 75 against the pressing roller 76 by the elastic member 79 may be employed.

In the descriptions of the above exemplary embodiments, a configuration in which an angle of the inclined surface as the cam surface of the slide cam 75 is constant has been described. However, the exemplary embodiments of the present invention need not to be limited to this. For example, a configuration in which, as displacement from the central position is larger, angle of inclination becomes more gentle may be used. Accordingly, slide followability of the sheet may be enhanced. In addition, the cam having a curved surface which is curved may be used.

Figure 9:
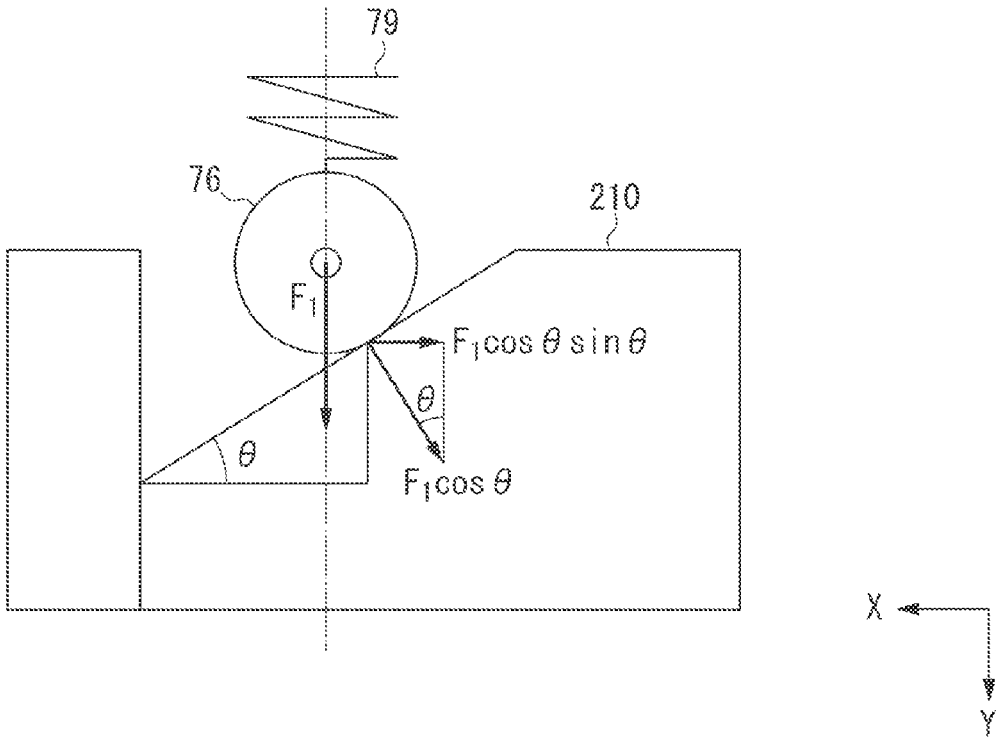
FIG. 9 illustrates a modified example of the central urging mechanism.

In the descriptions of the above exemplary embodiments, a configuration in which the slide cam 75 having the first inclined surface 75*a* and the second inclined surface 75*b* is shaped in left-right symmetry with respect to the neutral point 75X has been described, but the exemplary embodiments of the present invention are not limited to this. For example, depending on characteristics or the like of the apparatus, the first inclined surface and the second inclined surface may be formed at different angles. Further, in order to apply to an apparatus, in which the conveyance roller pair 115 moves only in one direction in the width direction when positional correction in the width direction of the sheet is performed, a cam 210 with a shape where only one inclined surface is provided as illustrated in FIG. 9 may be used.

In the descriptions of the above exemplary embodiments, a configuration in which the sheet conveyance apparatus according the exemplary embodiments of the present invention is provided upstream of the image forming unit has been described, but the exemplary embodiments of the present invention are not limited to this. For example, in an alignment device or the like for aligning the sheet after image formation, there is a device which is provided with a mechanism for correcting a position in the width direction of the sheet. The sheet conveyance apparatus according to the exemplary embodiments of the present invention may be applied to this device.

In the descriptions of the above exemplary embodiments, the CIS is arranged on the downstream side of the registration roller pair, but may be arranged on the upstream side. In this case, detection of a width-direction end portion position by the CIS may be also synchronized with the timing when the sheet stops just before the registration roller nip portion. Of course, the detection may be synchronized with the timing just before the registration roller pair shifts in the width direction after restart of the registration roller.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-102480 filed Apr. 27, 2012, which is hereby incorporated by reference herein in its entirety.

What is claimed is:

1. A sheet conveyance apparatus comprising:

a conveyance roller pair configured to convey a sheet while nipping the sheet; and a conveyance roller pair movement mechanism configured, while following movement of the sheet nipped by the conveyance roller pair in a width direction which perpendicularly crosses a sheet conveyance direction, to move the conveyance roller pair from a home position, and, in response to a trailing edge of the sheet passing through a nip portion of the conveyance roller pair, to return the conveyance roller pair to the home position, wherein the conveyance roller pair movement mechanism includes:

a cam provided with a cam surface that includes a first cam surface and a second cam surface opposite each other, a contact member configured to come into contact with the cam surface of the cam, and an urging member configured to urge the conveyance roller pair toward the home position by urging one of the cam and the contact member against the other.

2. The sheet conveyance apparatus according to claim 1, wherein, in a state that the conveyance roller pair is at the home position, the contact member comes into contact with both the first cam surface and the second cam surface.

3. The sheet conveyance apparatus according to claim 1, wherein the first cam surface and the second cam surface have a left-right symmetrical shape.

4. The sheet conveyance apparatus according to claim 1, wherein the first cam surface and the second cam surface include inclined surfaces or curved surfaces.

5. The sheet conveyance apparatus according to claim 1, wherein the contact member urges the conveyance roller pair to the home position by exerting same urging forces in both directions of the width direction to the cam.

6. The sheet conveyance apparatus according to claim 1, further comprising:

a downstream roller pair provided on a downstream side in the sheet conveyance direction of the conveyance roller pair and configured to convey the sheet while nipping the sheet; and a downstream roller pair movement unit configured to move the downstream roller pair in the width direction, wherein, in response to the downstream roller pair movement unit moving the downstream roller pair in the width direction, the conveyance roller pair movement mechanism moves the conveyance roller pair which nips the sheet from the home position while following the sheet, which moves in the width direction while being nipped by the downstream roller pair.

7. The sheet conveyance apparatus according to claim 6, further comprising an image forming unit configured to form an image on a sheet conveyed by the downstream roller pair after the downstream roller pair movement unit move the downstream roller pair in the width direction.

8. The sheet conveyance apparatus according to claim 1, further comprising a contacting portion provided on a downstream side in the sheet conveyance direction of the conveyance roller pair and configured to contact a leading edge of the sheet conveyed by the conveyance roller pair to correct a skew of the sheet, wherein, in response to the sheet conveyed by the conveyance roller pair contacting the contacting portion and moving in the width direction which perpendicularly crosses the sheet conveyance direction, the conveyance roller pair movement mechanism moves the conveyance roller pair nipping the sheet from the home position while following the sheet.

9. The sheet conveyance apparatus according to claim 1, wherein the contact member comes into contact with the first cam surface when the conveyance roller pair is moved from the home position to one side in the width direction, and the contact member comes into contact with the second cam surface when the conveyance roller pair is moved from the home position to the other side in the width direction, wherein, in a state that the contact member contacts the first cam surface, an urging force is exerted to the conveyance roller pair from the urging member in a direction in which the conveyance roller pair is moved to the other side, and wherein, in a state that the contact member contacts the second cam surface, the urging force is exerted to the conveyance roller pair from the urging member in a direction in which the conveyance roller pair is moved to the one side.

10. The sheet conveyance apparatus according to claim 1, wherein the conveyance roller pair movement mechanism includes a movement supporting portion configured to support the conveyance roller pair movable in the width direction.

11. The sheet conveyance apparatus according to claim 1, wherein the contact member includes a roller configured to rotate in contact with the first cam surface and the second cam surface and a holding member configured to hold the roller.

12. The sheet conveyance apparatus according to claim 1, wherein, in response to the conveyance roller pair and one of the cam and the contact member connected to the conveyance roller pair moving in the width direction from the home position, the urging member exerts an urging force to the conveyance roller pair in a direction reverse to a direction in which the conveyance roller pair has moved in the width direction, in response to the urging force from the urging member being exerted to the cam surface.

13. The sheet conveyance apparatus according to claim 1, wherein the cam is connected to the conveyance roller pair and the contact member is connected to an apparatus main body.

14. The sheet conveyance apparatus according to claim 1, wherein, at the home position, the urging member is positioned in line with an axis of the contact member and the central position of the cam.

15. The sheet conveyance apparatus according to claim 1, wherein, in a state that the conveyance roller pair is at the home position, the contact member comes into contact with both the first cam surface and the second cam surface, wherein the contact member comes into contact with only the first cam surface when the conveyance roller pair is moved from the home position to one side in the width direction, and the contact member comes into contact with only the second cam surface when the conveyance roller pair is moved from the home position to the other side in the width direction, and wherein, in the state that the contact member comes into contact with both the first cam surface and the second cam surface, the urging member exerts an urging force to the cam in both directions of the width direction, wherein, in the state that the contact member is in contact with only the first cam surface, the urging member exerts an urging force to the cam only in a direction in which the conveyance roller pair is moved to the other side, and wherein, in the state that the contact member is in contact with only the second cam surface, the urging member exerts an urging force to the cam only in a direction in which the conveyance roller pair is moved to the one side.

16. The sheet conveyance apparatus according to claim 1, wherein the cam surface of the cam is formed symmetrically in the width direction from a central position.

17. A sheet conveyance apparatus comprising:

a conveyance roller pair configured to convey a sheet while nipping the sheet; and a conveyance roller pair movement mechanism configured, while following movement of the sheet nipped by the conveyance roller pair in a width direction which perpendicularly crosses a sheet conveyance direction, to move the conveyance roller pair from a home position, and, in response to a trailing edge of the sheet passing through a nip portion of the conveyance roller pair, to return the conveyance roller pair to the home position, wherein the conveyance roller pair movement mechanism includes:

a cam provided with a cam surface formed symmetrically in the width direction from a central position, contact member configured to come into contact with the cam surface of the cam, and an urging member configured to urge the conveyance roller pair toward the home position by urging one of the cam and the contact member against the other.

18. The sheet conveyance apparatus according to claim 17, wherein the cam surface includes a first cam surface and a second cam surface opposite each other.

19. A sheet conveyance apparatus comprising:

a conveyance roller pair configured to convey a sheet while nipping the sheet; and a conveyance roller pair movement mechanism configured, while following movement of the sheet nipped by the conveyance roller pair in a width direction which perpendicularly crosses a sheet conveyance direction, to move the conveyance roller pair from a home position, and, in response to a trailing edge of the sheet passing through a nip portion of the conveyance roller pair, to return the conveyance roller pair to the home position, wherein the conveyance roller pair movement mechanism includes:

a contacted member provided with a surface that includes a first surface and a second surface, a contact member configured to come into contact with the surface of the contacted member, and an urging member configured to urge the conveyance roller pair toward the home position by urging one of the contacted member and the contact member against the other, wherein the contact member comes into contact with the first surface when the conveyance roller pair is moved from the home position to one side in the width direction, and the contact member comes into contact with the second surface when the conveyance roller pair is moved from the home position to the other side in the width direction, and wherein, in a state that the contact member contacts the first surface, an urging force is exerted to the conveyance roller pair from the urging member in a direction in which the conveyance roller pair is moved to the other side, and in a state that the contact member contacts the second surface, the urging force is exerted to the conveyance roller pair from the urging member in a direction in which the conveyance roller pair is moved to the one side.

20. An image forming apparatus comprising:

a conveyance roller pair configured to convey a sheet while nipping the sheet;

a conveyance roller pair movement mechanism configured, while following movement of the sheet nipped by the conveyance roller pair in a width direction which perpendicularly crosses a sheet conveyance direction, to move the conveyance roller pair from a home position, and, in response to a trailing edge of the sheet passing through a nip portion of the conveyance roller pair, to return the conveyance roller pair to the home position;

a downstream roller pair provided on a downstream side in the sheet conveyance direction of the conveyance roller pair and configured to convey the sheet while nipping the sheet;

a downstream roller pair movement unit configured to move the downstream roller pair in the width direction; and an image forming unit configured to form an image on a sheet conveyed by the downstream roller pair after the downstream roller pair movement unit move the downstream roller pair in the width direction, wherein the conveyance roller pair movement mechanism includes:

a cam provided with a cam surface that includes a first cam surface and a second cam surface opposite each other, a contact member configured to come into contact with the cam surface of the cam, and an urging member configured to urge the conveyance roller pair toward the home position by urging one of the cam and the contact member against the other, wherein, in response to the downstream roller pair movement unit moving the downstream roller pair in the width direction, the conveyance roller pair movement mechanism moves the conveyance roller pair which nips the sheet from the home position while following the sheet, which moves in the width direction while being nipped by the downstream roller pair.

* * * * *